US009393672B2

(12) United States Patent
Eliason

(10) Patent No.: US 9,393,672 B2
(45) Date of Patent: Jul. 19, 2016

(54) PRESSURE CONTROL CIRCUITS FOR BLASTING SYSTEMS

(71) Applicant: Ecoquip, Inc, Chesapeake, VA (US)

(72) Inventor: Keith Eliason, Virginia Beach, VA (US)

(73) Assignee: GRACO MINNESOTA INC., Minneapolis, MN (US)

( * ) Notice: Subject to any disclaimer, the term of this patent is extended or adjusted under 35 U.S.C. 154(b) by 204 days.

(21) Appl. No.: 14/052,295

(22) Filed: Oct. 11, 2013

(65) Prior Publication Data

US 2015/0105001 A1 Apr. 16, 2015

(51) Int. Cl.
*B24C 7/00* (2006.01)

(52) U.S. Cl.
CPC ..... *B24C 7/0084* (2013.01); *B24C 7/0053* (2013.01); *B24C 7/0061* (2013.01)

(58) Field of Classification Search
CPC .... B24C 7/0053; B24C 7/0007; B24C 7/0061
USPC ..... 451/99, 101, 2, 38
See application file for complete search history.

(56) References Cited

U.S. PATENT DOCUMENTS

| | | | | |
|---|---|---|---|---|
| 5,591,064 | A * | 1/1997 | Spears, Jr. | 451/2 |
| 2006/0016740 | A1 * | 1/2006 | Schultz et al. | 210/130 |
| 2012/0015592 | A1 * | 1/2012 | Eliason | 451/91 |

* cited by examiner

*Primary Examiner* — Monica Carter
*Assistant Examiner* — Lauren Beronja
(74) *Attorney, Agent, or Firm* — Bernard G. Pike, Pike IP Law, PLLC

(57) ABSTRACT

A blasting system having a pressure control circuit that automatically sets and balances pressures in the system to provide a more efficient blasting process. The pressure control circuits provide the ability and enable an operator to more easily and efficiently set the operating pressures of a wet abrasive blasting system, for example, for various blasting processes and easily obtain a consistent blast stream flow. Embodiments of the invention provide an accurate, simple, and intuitive control of the pressure supply system. In specific embodiments, the pressure control circuit controls both the supply pressure to an air driven water pump and the pressurized air supply to slurry mixer by setting only one of these pressures. In certain other embodiments of the pressure control circuit, both pressures may be set through operation of a single, multi-port selector valve.

16 Claims, 4 Drawing Sheets

PRESSURE CONTROL CIRCUITS FOR BLASTING SYSTEMS

FIELD OF THE INVENTION

The invention is directed to a pressure control circuit for an abrasive blasting unit. Embodiments of the pressure control circuit are for wet abrasive blasting systems used for cleaning, preparing surfaces, removing coatings, and/or other abrasive blasting operations. Embodiments of the pressure control circuit provide the ability and enable an operator to more easily and efficiently set the operating pressures of a wet abrasive blasting system for various blasting processes and easily obtain a consistent blast stream flow. Consistent slurry and pressurized gas flows contribute to a more efficient blasting operation. Embodiments of the invention provide an accurate, simple, and intuitive control of the pressure supply system. In specific embodiments, the pressure control circuit controls both the supply pressure to an air driven water pump and the pressurized air supply to slurry mixer by setting only one of these pressures. In certain embodiments of the pressure control circuit, the pressures may be set through operation of a single, multi-port selector valve.

BACKGROUND

To remove the paint, dirt or other surface coatings from a substrate such as a surface to be painted or cleaned, a blasting system is desirable and effective. There are a variety of blasting processes for these purposes, including, but not limited to, water blasting, dry abrasive blasting, and wet abrasive blasting. In certain applications, abrasive blasting systems are able to efficiently clean or remove a coating without damaging the underlying metal or other substrate; although in other applications, a certain degree of surface roughening may be desired.

The use of dry abrasive blasting with particles, such as those used in conventional sand blasting, may result in surface roughening. Typical blast particles are hard and abrasive in order to increase the efficiency of the blasting operation but may, therefore, result in damage to the substrate. Soft recyclable blast particles are sometimes substituted to avoid surface damage. These recyclable blast particles include, but are not limited to, agricultural products such as crushed walnut shells, crushed pistachio shells, corn husks, and rice hulls. Plastic particles are also sometimes used to reduce substrate surface damage but may also result in a reduction in efficiency of the blasting operation.

Wet abrasive systems have been used to also control and reduce surface damage. Wet abrasive systems combine the benefits of water blasting systems with dry abrasive blasting systems. In wet abrasive blasting, the fluid encapsulates particles of the abrasive media to simultaneously add mass to the abrasive and buffer the impact of the abrasive against the substrate to reduce potential surface damage. The encapsulated media still effectively strips or cleans the surface while the water also reduces the dust produced by dry blasting. However, wet abrasive systems require efficient delivery and mixing of a slurry stream with a pressurized gas stream to produce a consistent three-phase blast stream comprising a three-phase mixture of fluid, solid abrasive, and gas. If the mixing of slurry and pressurized gas is not well controlled, the blasting process is less efficient and, therefore, the benefits of the wet abrasive system are not fully realized.

Wet abrasive blasting systems typically comprise an air supply pressure regulator that may be adjusted to set the blast pressure. Typically, in a wet abrasive blast system, the blast pressure is defined as the pressure of the air supply upstream of the mixer. The air supply pressure regulator may be adjusted higher for a more aggressive blast process or adjusted lower for a less aggressive blasting operation. A less aggressive blasting process may be used for removing softer coatings or to prevent damage of softer or more vulnerable substrates from damage. However, in most cases, the blast pressure cannot be adjusted independently while maintaining an efficient blasting operation. A slurry flow control valve and/or a blast pot pressure must also be properly adjusted to provide a proper three-phase blast stream to the blast nozzle. However in operation, if the pressure and flow adjustments are not properly made, especially by inexperienced or under-trained operators, the blast process becomes inefficient, takes longer time to complete, and uses more blast media and/or water than necessary.

There is a need for a wet abrasive system that is easier to control in order for the benefits of a wet abrasive system to be more fully realized. In the past, the control has been overly complicated and required extensive training before an operator became fully proficient. Even then, there remained the possibility of operator error because operators do not understand the fluid dynamics of a wet abrasive system. The pressure setting of the blast pot or the blast pressure may be incorrectly set relative to the other pressures of the wet abrasive system.

SUMMARY

Wet abrasive systems comprise a combination of equipment, controls, and piping systems that allow the fluid flow to be controlled in order to provide various blasting operations to be performed, to remove the paint, dirt or other surface coatings from a substrate, such as a surface to be painted or cleaned. A wet abrasive blasting system includes piping systems for directing the fluid to different locations of the wet abrasive blasting system and to combine a pressurized gas stream and a slurry stream. In certain embodiments, the piping systems may comprise devices for controlling the pressure in at least two locations of the wet abrasive blasting system. For example, the two locations of the wet abrasive blasting system that may be controlled are 1) the blast pot pressure, pump discharge pressure, or pump air supply pressure to an air driven fluid pump and 2) a blast pressure or pressurized air pressure to the mixer. Embodiments of the wet abrasive blasting system comprise one pressure controller or regulator that ultimately controls both the blast pot pressure and the pressurized air pressure to the mixer. These two pressures are controlled to provide an efficient blasting operation.

The fluid piping systems and pressure control circuit allows for greater control and consistency of the mixing of the gas and slurry, resulting in a more consistent flow of the three-phase blasting stream and a more efficient wet blasting process. As used herein, "pipe" and "piping" shall mean any fluid containment device used to convey liquid or gas, such as a tube, hose, duct, pipe, or other similar structure. The pipe may have any cross-sectional shape, including rectangular, square, circular, or other shape. The flow area of the pipe is defined by its internal cross-sectional area. As used herein, "piping system" shall mean pipe, and other components used to connect one part of a system to another. The other components may include, but are not limited to, valves, check valves, elbows, tees, reducers, regulators, connectors, gauges or gauge connectors, flow or temperature sensors, pressure gauges, and control valves. As used herein, "fluid" or "fluids"

are liquids. Preferably the fluids are substantially incompressible fluids, such as water.

The terminology used herein is for the purpose of describing particular embodiments only, and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. In describing the invention, it will be understood that a number of components, parts, techniques and steps are disclosed. Each of these has individual benefit and each can also be used in conjunction with one or more, or in some cases, all of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

DESCRIPTION OF EMBODIMENTS OF THE INVENTION

Embodiments of a wet abrasive blasting system comprise a pressure control system. The pressure control system comprises a unique piping system that allows simple and effective control of the pressure supply system for the various operations of a wet abrasive blasting system. Wet abrasive systems comprise a combination of equipment, controls, and piping systems that allow a flow of slurry to be produced and mixed with a pressurized air flow to produce a three phase abrasive flow to perform various operations such as remove paint, dirt or other surface coatings from a substrate such as a surface to be painted or cleaned, for example.

Figure 1:
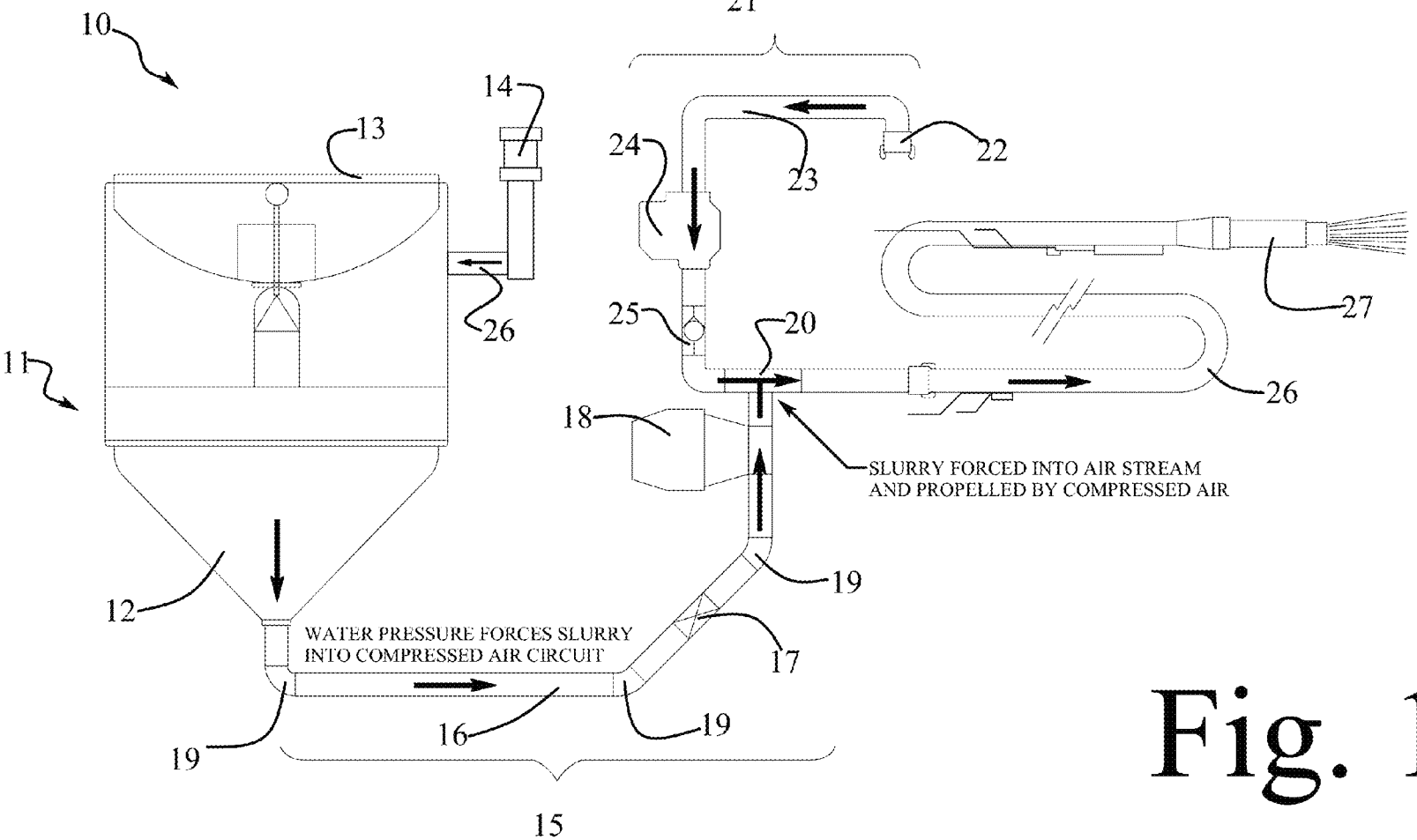
FIG. 1 is a general schematic drawing of a wet abrasive blasting system.

An embodiment of a wet abrasive system 10 is depicted in FIG. 1. This embodiment comprises a blast pot 11. The blast pot 11 comprises a conical bottom 12 with a slurry exit 19 positioned at the lower end of the conical bottom 12. Such a blast pot 11 is advantageous for use with solid particulate or media that is heavier (more dense) than the fluid, typically water, and which will not significantly oxidize or absorb a significant amount of the fluid used to carry and encapsulate the media. For a bottom discharge blast pot 11 as shown in FIG. 1, the abrasive media of the slurry may be any desired non-floating particulate matter capable of being transferred as slurry through the system. For example, the abrasive media may include media in the range of United States Standard Sieve Screen Size 100μ to ~10μ. The media and fluid are mixed into the blast pot; the ratio is variable as long as the slurry may be pushed through the slurry piping system fairly evenly and consistently.

Media such as sponge, untreated baking soda, ground corn cob, and some plastics have densities less than water and will float and/or absorb water. Such media may be used in a blast pot with a slurry exit at the top, such as a conical top, for example. Blast pots of other configurations may also be used in the wet abrasive blasting systems, such as pots with flat or elliptical bottoms, or pots with tops or bottoms of other desired shapes. The blast pot may further be comprised of a bung (pop-up) valve, flanged top, or other sealing mechanism 13 that allows the blast pot to be purged of gas and pressurized by a source of pressurized fluid, such as pump 14 or other source of pressurized fluid.

Thus, the system may also include a blast pot similar to conventional dry-blasting; however, unlike conventional dry-blasting, the vessel is pressurized by a fluid, such as water, and there is substantially no air in the vessel during the blasting operation. The pump 14 shown in the embodiment of FIG. 1 is an air-operated pump. An air-operated pump may be convenient for use in wet abrasive blasting systems as it may be operated from the same compressed air source used to connect to the pressurized gas piping. However, the fluid pump may be powered by any source, such as electricity in other embodiments, for example. The media and fluid are mixed into the blast pot and the slurry ratio is determined by the size and weight of the individual particle. The desired slurry ratio depends on the blasting operation to be performed, the aggressiveness of the blasting operation, and the material of the substrate to be cleaned or stripped, as well as other factors such as the composition of the coating being removed.

The cone-shaped bottom of the blast pot and the fact that the media is typically heavier than water causes the slurry to funnel into a hose or pipe that connects the blast pot to the input piping of the control panel wherein the mixer is located. In this manner, the slurry may be pumped or pushed into the mixer to be combined with the pressurized air to form the abrasive three phase blast spray. The abrasive spray is a combination of solid and liquid (from the slurry) and gas (from the pressurized gas source).

The wet abrasive blasting system 10 of FIG. 1 further comprises a slurry piping system 15 connecting the blasting pot 11 to the mixer 20. The slurry piping system 15 comprises pipe 16 and other components, including elbows 19, a manual shut-off valve 17, and an air operated shut-off valve 18. Other embodiments of the slurry piping system of the wet abrasive blasting system may or may not include these components and/or may include other components. The wet abrasive blasting system 10 of FIG. 1 further comprises a pressurized gas piping system 21. In this embodiment, pressurized gas piping system 21 comprises a compressed air connector 22 capable of connecting the gas piping system 21 to a source of pressurized gas such as, but not limited to, an air compressor or a pressurized tank, for example. The pressurized gas system 21 further comprises pipe 23, a pressure regulator 24, and a check valve 25. Other embodiments of the pressurized gas system of the wet abrasive system may or may not include these components and may or may not include other components. To properly mix with the pressurized air, the slurry may be forced into the mixer at a force or pressure substantially equal to or greater than the force or pressure of the compressed air as it passes through the slurry piping system and across the connection point of the slurry's piping into the mixer with the compressed air, on its way to and through the blast hose 26 and the blast nozzle 27.

For example as shown in FIG. 1, the slurry piping system 15 provides a fluid connection between blast pot 11 and slurry/gas mixer 20. In certain embodiments of the wet abrasive blasting system, the blast pot 11 contains a mixture of a solid particulate and a fluid (hereinafter "slurry"). The blast pot 11 is pressurized to push slurry through the bottom outlet of the blast pot 11 into the slurry piping system 15 at a desired flow rate from the blast pot 11 to the mixer 20. In most embodiments of wet abrasive blasting systems, the blast pot 11 is pressurized by a water pump or other pressurized fluid source. The blast pot pressure is typically measured at a top portion of the blast pot or in the water supply piping at the discharge of the pump 14. The blast pot may be pressurized and an initial static blast pot pressure may be set during the setup of the blasting operation, though this step may not be needed in certain embodiments of the wet abrasive blasting system.

In certain embodiments, the pressure control circuit may be set such that the static blast pot pressure is set at about 15 to about 25 psi higher than the intended blast pressure for blast pressures in the typical range. Testing has shown that as long as the dynamic blast pot pressure in the blast pot is maintained at or above the blast pressure, the slurry is forced into the air stream rather than air being forced backwards toward the blast pot. The static blast pot pressure is typically set higher than the required dynamic blast pot pressure as the blast pot pressure typically drops as the blasting operation is initiated. The dynamic blast pot pressure may be maintained or adjusted by adjusting a flow-control valve (metering valve) 28 in the water pump discharge line. The setting of the metering valve 28 predictably controls the volume of slurry being forced into the air stream in the mixer. The metering valve controls the flow of fluid into the pot (using pressurized fluid from the fluid pump) and thus also controls the volume of slurry forced into the air stream in the mixer since the fluid in the pot cannot be substantially compressed and, therefore, the volume of any fluid forced into the blast pot from the pump must equal the volume of slurry forced out of the blast pot.

The water pump is used to maintain the static blast pot pressure, maintain the dynamic blast pot pressure, and provide flow of slurry to the mixer. The initial static blast pot pressure should be set at a value that is greater than the intended blast pressure in order to consistently "force-feed" the media into the blast circuit while the blast circuit is operating under pressure. As used herein, static blast pot pressure is the initial pressure of the blast pot with all outlets closed with substantially no flow leaving the blast pot and the fluid pump is thereby maintaining its maximum discharge pressure at its current settings. For an air operated fluid pump, the maximum discharge pressure is set by adjusting the inlet air supply pressure to the pump motor. Raising the air supply pressure will result in a higher static blast pot pressure and lowering the inlet air supply pressure to the pump will result in a lower static blast pot pressure. To work efficiently, the initial static blast pot pressure should not be set too much greater than the intended blast pressure.

The dynamic blast pot pressure is the pressure in the blast pot during the blasting operation and will be lower than the static blast pot pressure. The pressurized gas piping system 21 is connected to a source of pressurized gas such that the gas may be conveyed through the pressurized gas piping system 21 to the slurry/gas mixer 20 and is capable of conveying the desired flow rate of pressurized gas to the mixer 20 to form the three phase flow and convey the three phase flow through the blast hose and out the blast nozzle. The pressure of the gas supplied to the slurry/gas mixer 20 may be controlled by a pressure regulator 24. The pressure regulator 24 is used to set or adjust the blast pressure as different blast pressures may be needed for different operations. As used herein, the blast pressure is the pressure of the pressurized air supply measured after the pressure regulator 24 and prior to the mixer 20 during a blasting operation. Though the blast pressure may be measured at other parts of the piping system in other embodiments of the invention resulting in different differential pressure settings. Measuring the blast pressure prior to the mixer is convenient as the pressure gauge or sensor is exposed only to air during normal operation and the chances of being clogged with solids from the slurry is prevented and greatly reduced if an error occurs. In addition, additives may be combined with the fluid or the gas, as desired, such as, but not limited to, to prevent flash rusting or to keep the liquid from freezing. To create a consistent flow of slurry, the blast pot typically may be maintained at a dynamic blast pot pressure or the blast pressure in the range from approximately 30 psi to approximately 130 psi. In other cases, the blast pot pressure may be higher in certain high-pressure blasting operations.

To setup a blasting operation, media is added to the blast pot through an opening. A fluid pump is used to substantially fill and pressurize the blast pot. A sealing valve, a self-venting valve, and/or bung is used to seal the blast pot once the blast pot is sufficiently free of compressible gas. As the fluid pump continues to pump, fluid pressure will develop in the blast pot. The blast pot reaches its static blast pot pressure when the pump cannot pump any further liquid against the static blast pot pressure. In a conventional wet abrasive blasting system, the operator may adjust the pressure in the blast pot, at this time, to the desired pressure for the specific blasting operation to be performed. The pressure may be purged from the blast pot and the air supply pressure of the pump may be adjusted until the desired static blast pot pressure is achieved. Prior to or after setting the static blast pot pressure, the operator may adjust the air supply regulator to the desired blast pressure.

At the beginning of the blasting operation, the blast pot will be opened to allow flow of the slurry to the mixer. The pump will respond to the reduction in pressure of the blast pot and at the discharge of the pump as fluid is removed from the blast pot, and start pumping fluid into the blast pot. The pump discharge flow attempts to maintain the pressure in the blast pot and during a blasting operation forces the slurry into the mixer via the slurry piping system.

The driving force of the slurry through the spray nozzle of the wet abrasive blast system may be provided by a high-volume (40~900 cubic feet per minute (CFM), for example) air compressor attached to the pressurized piping system. The pressure at which the compressed air is delivered to the mixer is the blast pressure, and may be controlled by an air regulator designed to handle the volume of air being supplied by the compressor. In operation, the compressed air "powers through" the slurry being forced into the air/slurry stream. It is this action that causes the slurry to be "picked up" and propelled through the piping, the blast hose, and the nozzle.

The mixture of compressed air, fluid, and media is accelerated by the action of the nozzle and becomes the working blast force used for cleaning, stripping, and removing unwanted coatings, linings, or rust. Propulsion is effectively enhanced due to the fluid mixed with the media (slurry).

During blasting, the blast pot, the pressurized air supply, and the blast circuit are in fluid communication at the mixer. In the embodiment shown in FIG. 1, the mixer may be considered to be a pressure-aided venturi, wherein the flow of pressurized gas through the straight section of the mixer creates a slight reduced pressure at the tee section of the mixer. Once the slurry flow piping circuit and the pressurized gas circuit are open and in fluid communication at the mixer for a blasting operation (the pressure vessel, containing liquid and abrasive, and the blast circuit, containing pressurized gas), pressure will tend to equalize in both systems at the mixer. This is due to the fact that both circuits are now fluidly connected to each other, so there is nothing to isolate one pressure zone from the other zone. The downstream pressures of each system will depend on the fluid dynamics and pressure drop of the flowing slurry and gas.

The dynamic blast pot pressure will be substantially equal to the blast pressure and the pressure drop through the slurry piping. The pressure drop through the slurry piping will depend on many factors including the design of the piping system, the ratio of media to fluid, the type of media, and the physical properties and flow rate of slurry, for example. The blast pressure is at least partially determined by the pressure drop of the three phase flow from the mixer through the blast piping, through the blast hose and the blast nozzle. The inventors have discovered that this principle of fluid dynamics and physics is not understood by operators of wet abrasive blasting equipment. Consequently, when operators see that the dynamic blast pot pressure is lower than initial static blast pot pressure the operator misinterprets the lower dynamic blast pot pressure as a fault or set up error. As discussed above, the dynamic blast pot pressure during a blasting operation is substantially equal to the blast pressure plus the pressure drop through the slurry piping. The operator had been taught or told that the blast pot pressure should be set at an initial value and does not understand that the pressure does not need to remain at that value during a blasting operation.

Therefore, certain operators adjust the dynamic blast pot pressure in the vessel during a blasting operation. A normal reaction of the operator is to try and re-adjust the blast pot's pressure during blasting back to the static blast pot pressure. Operators incorrectly believe that this pressure should be maintained during blasting to provide an efficient blasting operation. Due to the principles of fluid dynamics described above, however, the higher initial static blast pot pressure setting cannot be attained without increasing the pressure drop in the slurry piping or the blast pressure while the two systems are in communication. Consequently, as an operator attempts to make an adjustment to the pressure setting of the blast pot during blasting operation (typically by increasing the air supply pressure to the air driven water pump) the results cause an incorrect setting. Quite commonly, the operator will, in error, set the blast pot pressure to a maximum value. This will cause the water pump's feedback setting (because it reacts to the raised input of its air regulator) to increase the flow rate, and feed too much water to the blast pot, resulting in a super-saturated blast ratio of too much media and/or too much water mixed into the pressurized gas (air). The result of the erroneous pressure setting by trying to make the dynamic blast pot pressure equal to the static blast pot pressure may cause several different problems with a blasting operation resulting in excessive consumption of media and/or water resulting in a an inefficient blasting operation, and more importantly, the inefficient blasting operation could generate water run-off (a major environmental concern according to many countries' laws and U.S. state regulations—especially in California). More significantly, the coating or other material being removed from the substrate in the blasting operation is carried by the water run-off and could contain contaminants that may damage the environment.

In certain cases, the pressure vessel will act more like a sand filter than it will act as a controlled means to force wet media into a pressurized air stream. In such a case, the media is "pulled" along with the water into the slurry piping making for an incorrect ratio of water, media, and compressed air. In other instances, if the pump discharge pressure setting is set too high, the pressurized water above the media's top surface in the blast pot will no longer act as intended—as a "piston" exerting uniform pressure on the surface of the media. Instead, the fluid may channel through the media; creating passage-ways that allow the water to flow along a path of least resistance, through or around the media without entraining the desired ratio of media to fluid. The passage-ways may form along the side walls of the blast pot or may form a "water channel" through the media. Thus, the fluid will exit the blast pot carrying excessive media—similar to the effect of a syphon.

Through experimentation and testing, the inventor has determined that an initial static blast pot pressure vessel differential setting of approximately 20 psi higher than an intended blast pressure will result in properly feeding the slurry from the blast pot into the slurry piping and into the mixer. This pressure differential has been extensively tested over a blast pressure range of 30 psi through 130 psi. At greater blast pressures, the difference between the static blast pot pressure and the blast pressure may be higher and, at lower blast pressures, the difference between the static blast pot pressure may be smaller. The inventor theorizes that the wet media is able to resist the formation of water channels and does not become overly porous at these operating pressure ranges. Below about a 15 psi differential at a blast pressure of 100 psi, the "force-feeding" of media into the mixer is compromised and not consistent. Above about a 25 psi differential at a blast pressure of 100 psi, the media is no longer able to "seal" and resist the formation of the water channels while the operator is blasting. The adjustment of the static blast pot pressure and the blast pressure allows the wet abrasive blasting system to be set up for various operations. The wet abrasive blasting system must be able to be versatile enough to remove coatings from hard surfaces and softer surfaces and to allow efficient removal of both hard and soft coatings. The adjustments necessary to achieve this versatility leads to potential operator errors.

The inventors have recognized this problem and resolved the problem by configuring a wet abrasive blasting system that provides an automatic setting of both the static blast pressure (air pressure to the air driven pump) and the blast pressure with one selector switch or by setting one of these pressures, the other pressure will be set to a desired setting based upon the first pressure setting. In conventional wet abrasive blasting systems, an operator must individually set the static blast pot pressure and the blast pressure prior to performing a blasting operation. This invention serves to eliminate the common operator error—setting the initial pressure too high—or more significantly, re-adjusting a correctly set initial pressure during blasting, and unintentionally causing the resulting pressure differential to be too great.

Follower Pressure Regulator

In one embodiment, the wet abrasive system comprises a follower pressure regulator valve. Embodiments of the wet abrasive blasting system comprising a follower pressure regulator valve allows a pressure differential between the blast pressure and the static blast pot pressure to be automatically set without independent adjustment from the operator. The operator may merely set one pressure and the second pressure is automatically set. The follower pressure regulator valve includes a pressurized gas inlet, a pressurized gas outlet, and a control air inlet that controls the outlet pressure of the follower pressure regulator valve. In embodiments of a follower pressure regulator, the outlet pressure can be controlled to be a factor of the control pressure. In embodiments of the wet abrasive blasting system, the same pressure source is in fluid communication with the control air inlet and the inlet to the air driven water pump.

Using a follower pressure regulator valve allows a pressure differential to be maintained even if the blast pressure is changed during the blasting operation. This embodiment may be readily implemented in embodiments of a wet abrasive blasting system comprising an air-driven water pump. The implementation of such an embodiment of the wet abrasive blasting system is complicated due to the fact that air driven pumps are generally not a one-to-one air supply pressure to maximum discharge pressure ratio pumps. For example, a pump air supply pressure will produce a higher maximum discharge pressure from the pump. For instance, an air supply pressure of 20 psig will produce a maximum pump discharge pressure or static blast pot pressure of 90 psi in a 4.5 to 1 pressure ratio pump. This means that the maximum discharge pressure of the air driven pump is 4.5 times the air supply pressure to the drive motor. In this embodiment, supplying 25 psi of air pressure to the pump drive results in a maximum pump discharge pressure of 112.5 psi. In most air driven pumps, the maximum pump discharge pressure has a substantially linear relationship with the pump air supply pressure over the normal operating range for wet abrasive blasting systems.

In one embodiment, the wet abrasive blasting system comprises a signal amplifier ("follower pressure regulator") 24 that is capable of regulating a supply source of air, based upon an input air pressure source, in the ratio determined by the differential of the surface areas of two diaphragms or pistons in the follower pressure regulator.

Figure 2A:
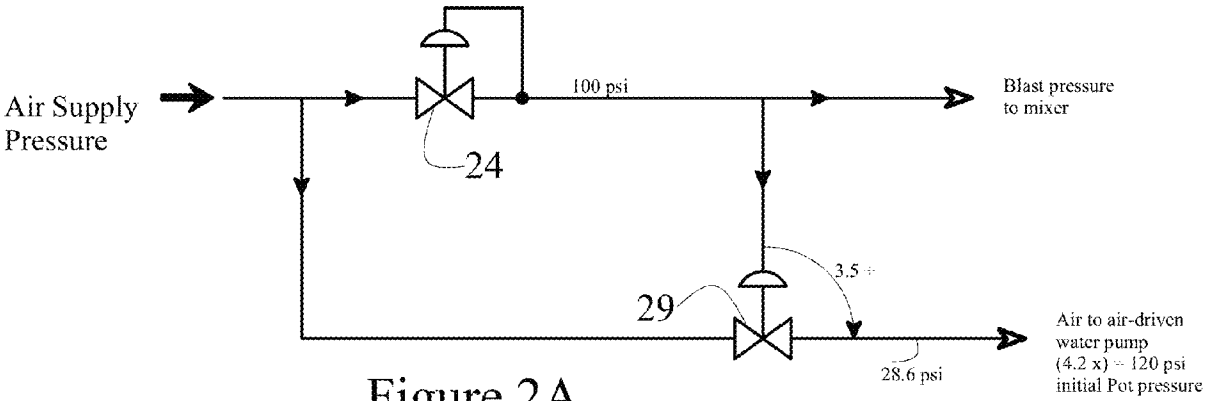
FIGS. 2A and 2B are a schematic drawings of embodiments of a pressure control circuit of a wet abrasive blasting system comprising a follower pressure regulator.

In one embodiment as shown in FIG. 2A, the operator sets a blast pressure by adjusting the blast pressure regulator 24. The outlet of the blast pressure regulator 24 is in fluid communication with the mixer 20. The outlet of the blast pressure regulator 24 is also in fluid communication with the air control inlet of a follower regulator valve 29. In this embodiment, the follower regulator valve 29 is set to control its outlet pressure equal to the air control inlet pressure divided by 3.5. For example, if the blast pressure, and therefore the air control inlet pressure to the follower regulator valve 29, is set to 100 psi, the outlet of the follower regulator valve 29 is set to have an outlet pressure of 28.6 psi. In this embodiment, the outlet of the follower regulator valve 29 is in fluid communication with the air supply inlet to an air driven pump 14.

In this particular embodiment, the wet abrasive blasting system comprises an air driven water pump 14 that has a nominal 4.5 to 1 pumping pressure ratio. However, testing of air driven pumps indicates that after a wear-in period, the pressure ratio of pump air supply pressure to maximum discharge pressure is actually lower than the nominal 4.5 to 1 pressure ratio and is reduced to approximately 4.2 to 1. Therefore, in a medium blasting operation with a 100 psi blast pressure with a desired 20 psi pressure differential between the blast pressure and the static blast pot pressure, the pump air supply from the dual control pressure regulator 29 to the air driven pump should be approximately 28.6 psi. As described above, the 100 psi air inlet control pressure controls the follower regulator valve 29 outlet pressure and the pump air supply pressure to be the desired 28.6 psi. The pump air supply pressure of 28.6 psi to an air driven pump with a 4.2 to 1 pressure ratio results in a maximum discharge pressure (static blast pot pressure) of approximately 120 psi.

Figure 2B:
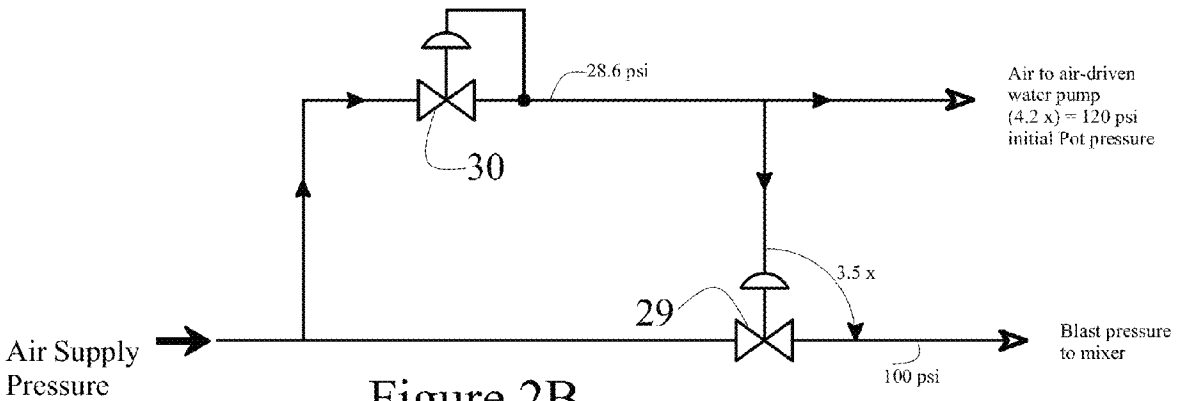

In another embodiment shown in FIG. 2B, the pressurized air supply is in fluid communication with the inlet to the follower regulator valve (blast pressure regulator) 29 and with the inlet to the air driven pump pressure regulator 30. The outlet of the air driven pump pressure regulator 30 sets the control pressure and is in fluid communication with the air control inlet of the follower pressure regulator (blast pressure regulator) 29 and with the air inlet to the air driven pump 14. The outlet of the follower pressure regulator (blast pressure regulator) 29 is in fluid communication with the mixer 20. The follower pressure regulator 29 senses the control pressure and, in this embodiment, regulates and controls the outlet pressure to 3.5 times the control pressure. A typical follower pressure regulator has a linear relationship between the inlet pressure and the outlet pressure over its normal operating range. Therefore, in such embodiments of the wet abrasive blasting system, the outlet of the air pump supply pressure regulator 30 is the control pressure of the follower regulator valve and the air pressure for the air driven pump.

In the embodiment described above, for example, the follower pressure regulator may have a 3.5 to 1 outlet pressure (blast pressure) to control pressure (pump air supply pressure) ratio. In the example embodiment above, a medium blast pressure of 100 psi is desired for the blast pressure. The pump air supply pressure is in fluid communication with the control inlet of the follower pressure regulator valve 29 to control the outlet pressure of the follower pressure regulator valve (blast pressure) at 100 psi. As described above, setting the pump air supply pressure to 28.6 psi will result in a maximum pump discharge pressure (static blast pot pressure) set to approximately 120 psi or 20 psi greater than the blast pressure. The inventor has found that this will result in an efficient blasting process.

Consequently, over the majority of the life expectancy of the water pump's seals, this embodiment also will maintain approximately a 20 psi differential between a 100 psi blast pressure setting that will automatically be set by the follower pressure regulator and the static blast pot pressure setting. Consequently, there is no additional adjustments needed to be performed by the operator; thus removing an important source of operator error. Such embodiments of the wet abrasive blasting system provide an adjustable blast range from about 30 psi through maximum pressure.

As a further example of use of the embodiment of the wet abrasive blasting system of FIG. 2 for a low blast pressure such as with the blast pressure regulator and, thus, the control pressure of the follower pressure regulator valve set at 60 psi, the follower pressure regulator valve output for the pump air supply pressure will be 17.1 psi. (60 psi/3.5=17.14). The 17.1 air supply pressure will result in a static blast pot pressure of 72 psi in an air driven pump as described above. (17.14× 4.2=71.99).

In the embodiment described above wherein the wet abrasive blasting system comprises an air driven pump with an approximately 4.2 to 1 maximum pumping pressure to air supply pressure and a follower pressure regulator that reduces the blast pressure 3.5 times to provide a pump air supply pressure, an overall pressure factor for determining the static blast pot pressure based upon the blast pressure is 1.2 (4.2/3.5=1.2). Different configurations of pumps and follower pressure regulators may be used that would result in different pressure ratios and overall factors. An embodiment of a wet abrasive blasting system comprising a follower pressure regulator valve with a control inlet in fluid communication with the blast pressure air to the mixer and an outlet connected to the air supply of an air driven pump allows setting a blast pressure with automatic regulation of the static blast pot pressure setting and consequently the dynamic blast pot pressure.

Regulator Pairs

Figure 3:
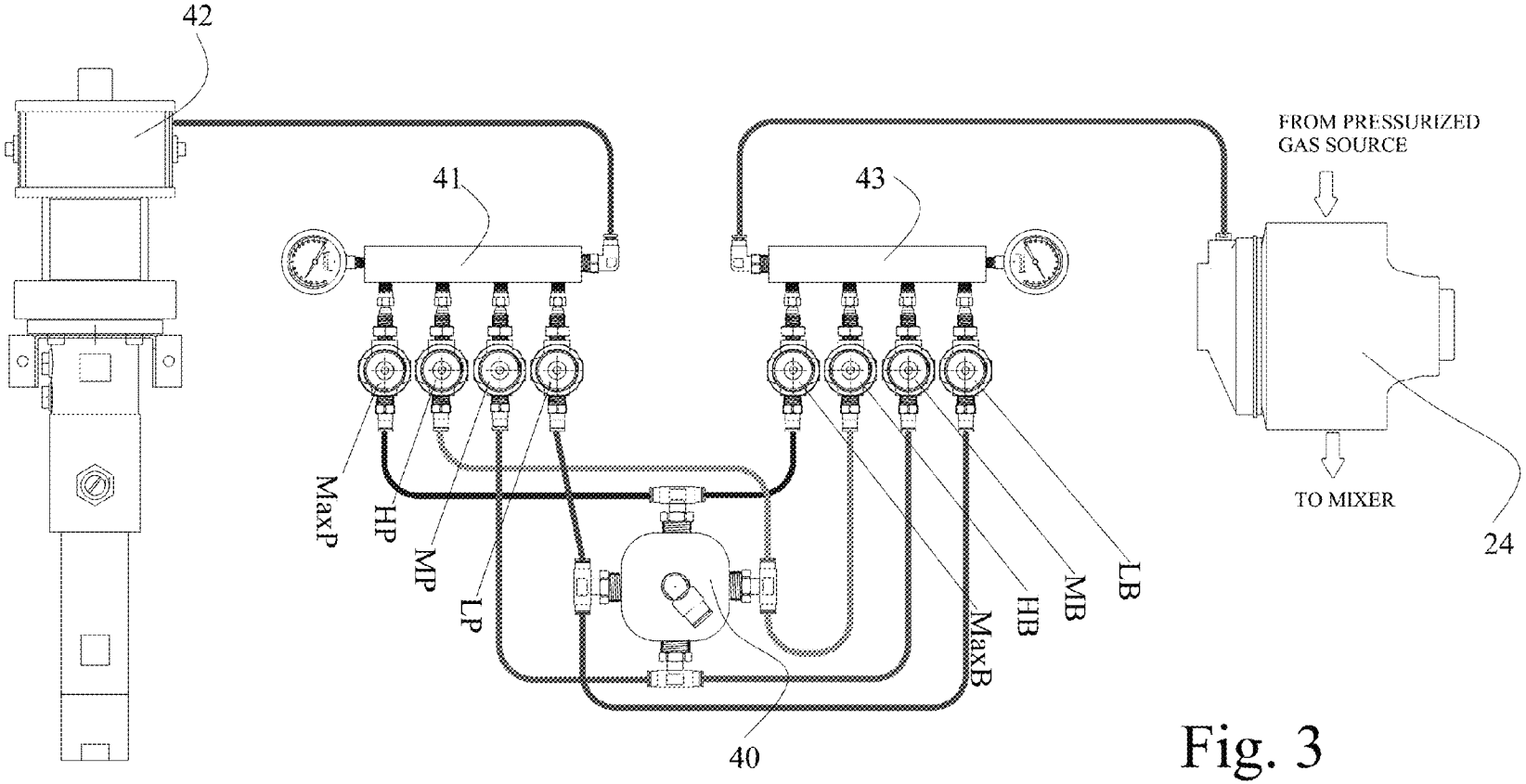
FIG. 3 is a schematic of an embodiment of a pressure control circuit of a wet abrasive blasting system comprising four pairs of blast pressure regulators and pump air supply pressure regulators and a selector valve for independently selecting the operating pair of regulators.
Figure 4:
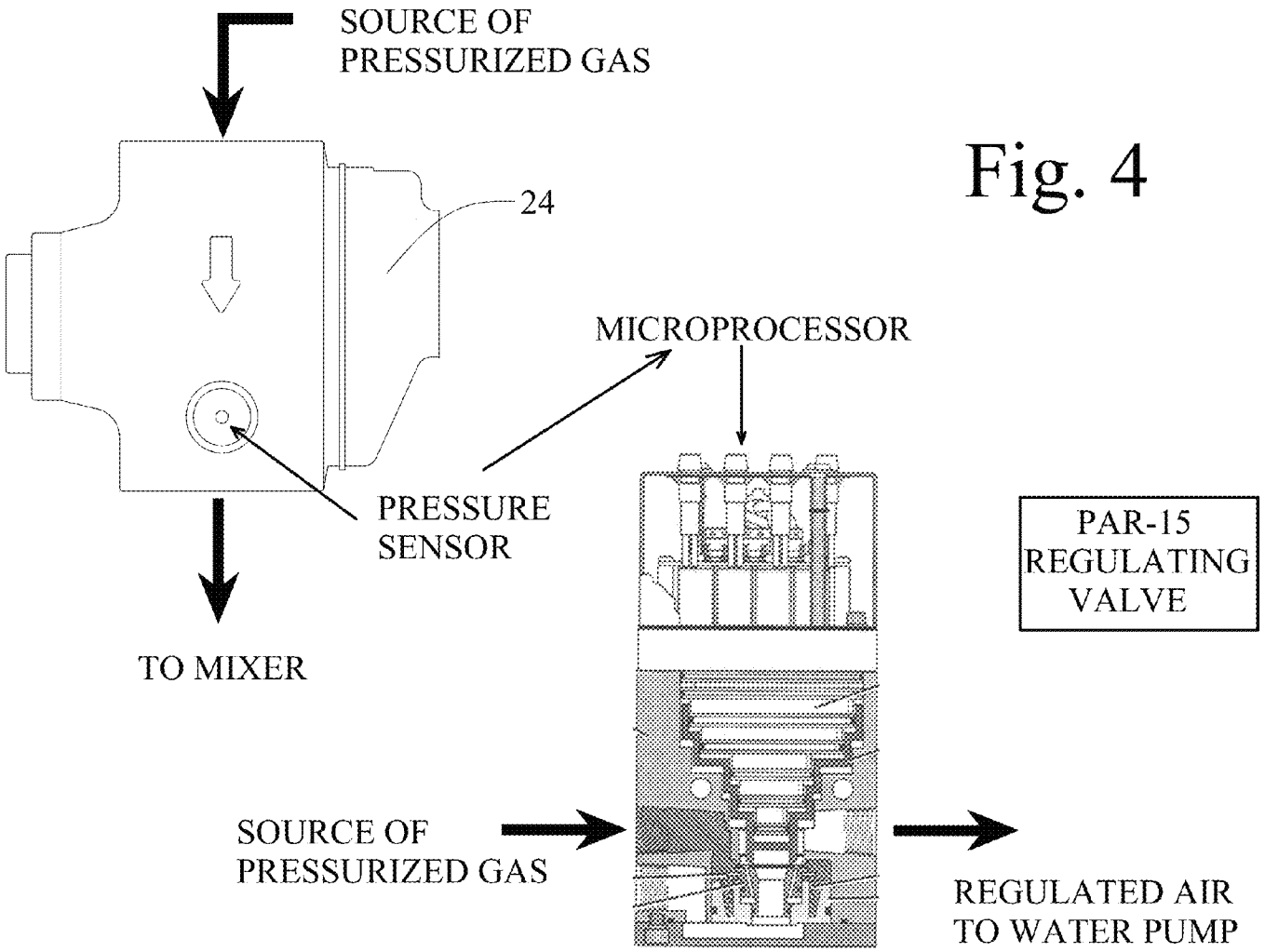
FIG. 4 is a schematic of an embodiment of a pressure control circuit of a wet abrasive blasting system comprising a programmable pressure regulator for setting the pump air supply pressure based upon the setting of the blast pressure.

Another embodiment of the wet abrasive blasting system comprises at least two pairs of pressure regulators and a selector valve to provide selective fluid communication between an air supply and at least two pairs of pressure regulators. In one embodiment, each pair of pressure regulators comprises a pump air supply pressure regulator and a blast pressure regulator. In another embodiment as shown in FIG. 3, each pair of pressure regulators comprises a pump air supply pressure regulator and a blast pressure control regulator. The blast pressure control regulator provides control air to a follower regulator, wherein the follower regulator is the blast pressure regulator. In a still further embodiment, the pair of pressure regulators may include a pump air supply control pressure regulator. Generally, the pair of regulators includes a regulator or series of regulators that control the pump air supply pressure and a regulator or series of regulators that control the blast pressure.

An embodiment of the pressure control circuit comprises a multiport selector valve comprising a fluid inlet and at least two fluid outlets, including a first fluid outlet and a second fluid outlet. The selector valve allows selective fluid communication between the fluid inlet and either the first fluid outlet or the second fluid outlet. Each of the first fluid outlet and second fluid outlet is in fluid communication with the inlets of each of the pump air supply pressure regulators and a blast pressure regulator or the blast pressure control regulator in the selected pair of pressure regulators.

In a further embodiment, a wet abrasive blasting system comprises a rotary selector valve comprising an inlet that may be selectively in fluid communication with any of four fluid outlets. Each of the four outlets is in fluid communication with a pair of pressure regulators including a pump air supply pressure regulator and a blast pressure regulator. Each pair of pressure regulators comprises a blast pressure regulator 24 and an air pump pressure regulator that are set to provide a proper pressure ratio to each location to provide for efficient wet blasting operation. In one embodiment, each of the four blast pressure regulators are set at different pressures. For example, one pair of pressure regulators may be set for a maximum blast pressure, a second pair of regulators set for a high pressure blasting operation, a third pair of regulators set for a medium pressure blasting operation and a fourth pair of regulators set for a low pressure blasting operation. See example pressure settings for each regulator in each pair of regulators in Table 1 below.

In other embodiments, the selector valve may be in fluid communication with more or less pairs of pressure regulators. Each regulator in the pair can be "fixed," factory pre-set or adjusted to the correct settings to supply the pump and the blast regulator with the correct pressures to maintain a proper differential, such as a 20 psi differential for a 100 psi blast pressure, needed for each of the fixed blast settings.

In another embodiment for maximum blasting pressure, one outlet of the selector valve is not connected to a pair of pressure regulators but only to a pump air supply pressure regulator and the pressurized air supply is not reduced to provide the blast pressure.

In the embodiment of the wet abrasive blasting system shown in FIG. 3, the operator only needs to select the low, medium, high, or maximum blasting operation by setting the selector valve 40 in the appropriate position to select the appropriate pair of regulators to provide the wet abrasive blasting system with the desired static blast pot pressure and blast pressure. The selector valve provides fluid communication to the proper pair of pressure regulators that have "fixed" settings for each of the different blasting intensities. The inlet of the selector valve is in fluid communication with a source of pressurized gas that has a higher pressure than the setting of any of the pressure regulators in the system.

In the "LOW" position of the selector valve, the inlet of the selector valve is in fluid communication with a low pressure blast pressure control regulator, LB, and low pressure pump air supply pressure regulator, LP. The low pressure air supply pressure regulator is in fluid communication with manifold 41 to provide pump air supply pressure to air driven pump 42. The low pressure blast pressure regulator is in fluid communication with manifold 43 to provide control air to the blast pressure regulator 24 that delivers pressurized gas to the mixer.

In the "MEDIUM" position of selector valve, the inlet of the selector valve is in fluid communication with a medium pressure blast pressure control regulator, MB, and medium pressure pump air supply pressure regulator, MP.

In the "HIGH" position of selector valve, the inlet of the selector valve is in fluid communication with a low pressure blast pressure control regulator, HB, and low pressure pump air supply pressure regulator, HP.

In the "MAXIMUM" position of selector valve, the inlet of the selector valve is in fluid communication with a maximum pressure blast pressure control regulator, MaxB, and low pressure pump air supply pressure regulator, MaxP.

In each pair, both the blast pressure control pressure regulator and the pump air supply pressure regulators are set to match, allowing for a properly set differential between static blast pot pressure and blast pressure without requiring additional pressure adjustments from the operator. For example, the pressure regulators may be set to provide the blast pressure and pump air supply pressures as shown in Table 1 for each blasting operation available on the selector. In embodiments to the wet abrasive system comprising control pressure regulators, the outlet pressure of the control pressure regulator is properly set to control the follower regulator to provide the appropriate pressure. Also, included in Table 1 is the resultant static blast pot pressure resulting from the pump air supply pressure using a 4.2 to 1 pressure ratio pump.

TABLE 1

Example of paired pressure regulator settings.

| Selector Setting | Blast pressure | Pump Air Supply Pressure (4.2 to 1) | Static Blast Pot Pressure |
|---|---|---|---|
| Low | 60 psi | 17.9 psi | 75 psi |
| Medium | 80 psi | 23.1 psi | 97 psi |
| High | 100 psi | 28.6 psi | 120 psi |
| Maximum | 130 psi | 36.2 psi | 152 psi |

The paired pressure regulator settings are examples only. Other pressure regulator settings may be used depending on the potential applications of the wet abrasive blasting operation, the size of the equipment, the pressure ratio of the water pump, the pressure capabilities of the air compressor, the blast pot pressure rating, the desired use of water and media, as well as other factors.

The blast pressure regulator may be directly selected with the multiport selector valve or indirectly set by selecting a secondary blast pressure regulator that controls the pressure setting of the primary blast pressure regulator 24 as shown in FIG. 3. If necessary, check valves may be installed at the outlets of the selector valve or in the manifold piping systems to prevent back flow of air throughout the system.

Programmable Air Regulating Valve:

In another embodiment of the invention, the wet abrasive blasting system comprises a programmable air regulator (such as PAR-15, Programmable Air Regulating Valve available from Parker Hannifin Corporation), wherein the programmable air regulator is capable of setting a static blast pot pressure based on the input from a sensor measuring the blast pressure. In certain applications, this may be a preferred embodiment since the blast pressure does not significantly change during a blasting operation or from a static system to a dynamic system. In still another embodiment, the programmable air regulator may set the blast pressure based upon a sensor in the blast pot.

The programmable air regulator comprises a microprocessor with an input from a pressure sensor (for example, a pressure sensor indicating the blast pressure). The microprocessor then sends the proper information as programmed to the regulator's four solenoid valves. The regulator is then set for the corresponding second pressure (such as the pressure of the air supply to an air driven pump). In one embodiment, the microprocessor controls four solenoids, which when activated in the proper combinations, can adjust the air pressure to the pump air supply in 15 different output pressures. Each of the solenoid valves may comprise different size orifices that may be activated by the microprocessor in fifteen different combinations to provide different output pressures. This allows matching the water pump's output to the blast pressure within the desired differential range. The air regulating valve's response is both substantially instant and repeatable, reducing the need for expensive feedback controls.

All three embodiments described above, and other embodiments of a wet abrasive blasting system with automatic setting of at least one pressure, accomplish the same goal—the embodiments have the ability to automatically maintain the water pump's setting based on the blast pressure setting, set the blast pressure based upon the water pump air supply pressure setting, or set both pressures simultaneously. This provides the same results as manually setting an initial pressure vessel setting 20 psi higher than the actual blast pressure, without the need for additional input from the operator. In other words, the operator only needs to set one desired pressure (the blast pressure, the blast control pressure, the air supply to the air driven fluid pump pressure, the air supply to the air driven fluid pump control pressure, or the blast pot pressure), and the pump's pressure setting is correctly determined by one of the three methods described, without any additional input from the operator. This invention prevents a major source for operator error when using wet abrasive blasting operations. Other means for controlling at least one of, the blast pressure regulator or the air supply pressure regulator, based upon the setting of the other (the blast pressure regulator or the air supply pressure regulator) include programmable logic controllers, central processing unit pressure control, two independent selector switches for each pressure regulator, as well as other methods.

The embodiments of the described pressure control circuits and wet abrasive blasting systems are not limited to the particular embodiments, components, method steps, and materials disclosed herein as such components, process steps, and materials may vary. Moreover, the terminology employed herein is used for the purpose of describing exemplary embodiments only, and the terminology is not intended to be limiting since the scope of the various embodiments of the present invention will be limited only by the appended claims and equivalents thereof.

Therefore, while embodiments of the invention are described with reference to exemplary embodiments, those skilled in the art will understand that variations and modifications can be effected within the scope of the invention as defined in the appended claims. Accordingly, the scope of the various embodiments of the present invention should not be limited to the above discussed embodiments, and should only be defined by the following claims and all equivalents.

The invention claimed is:

1. A wet abrasive blasting system, comprising:

a mixer for mixing a slurry stream and a pressurized gas stream for forming a three phase flow;

a blast pressure regulator, wherein the blast pressure regulator controls the pressure of the pressurized gas upstream of the mixer;

an air supply pressure regulator, wherein the air supply pressure regulator controls the air pressure to an air driven pump; and means for automatic setting of both the blast pressure and the air supply pressure regulator simultaneously thereby controlling at least one of the blast pressure regulator and the air supply pressure regulator based upon a setting of the other of the blast pressure regulator and the air supply pressure regulator.

2. The wet abrasive blasting system of claim 1, wherein means for automatic setting of both the blast pressure and the air supply pressure regulator simultaneously is a follower pressure regulator.

3. The wet abrasive blasting system of claim 1, wherein means for automatic setting of both the blast pressure and the air supply pressure regulator simultaneously is a programmable regulating valve.

4. The wet abrasive blasting system of claim 1, wherein at least one of the blast pressure regulator or the pump air supply pressure regulator is controlled such that the ratio of blast pressure to pump air supply pressure is in the range of about 2.5 to about 4.0.

5. The wet abrasive blasting system of claim 1, wherein the air supply pressure regulator controls the air pressure to an air driven pump and a pressure setting of the pump air supply pressure regulator determines the maximum discharge pressure of the air driven pump.

6. The wet abrasive blasting system of claim 5, wherein the at least one of the blast pressure regulator or the air supply pressure regulator is controlled such that the ratio of maximum discharge pressure of the air driven pump to blast pressure is in the range of about 1.1 to about 1.4.

7. The wet abrasive blasting system of claim 5, wherein at least one of the blast pressure regulator or the air supply pressure regulator is controlled such that the ratio of maximum discharge pressure of the air driven pump to blast pressure is in the range of about 1.15 to about 1.25.

8. The wet abrasive blasting system of claim 2, wherein follower pressure regulator is the air pressure regulator valve and an outlet pressure of the follower pressure regulator is controlled by the blast pressure regulator.

9. The wet abrasive blasting system of claim 8, wherein blast pressure regulator of the follower pressure regulator controls the outlet pressure of the follower pressure regulator, the outlet pressure of the follower pressure regulator drives the air driven pump, and a ratio of maximum discharge pressure of the air driven pump to blast pressure is in the range of about 1.1 to about 1.4.

10. A wet abrasive blasting system, comprising:

a source of pressurized air in fluid communication with an inlet of a multi-port selector valve, wherein the multiport selector valve comprises a first outlet port and a second outlet port;

a mixer for mixing a slurry and a pressurized gas for forming a three phase flow;

a first set of regulators in fluid communication with the first outlet port;

a second set of regulators in fluid communication with the second outlet port, wherein each set of regulators comprises a blast pressure regulator and a pump air supply pressure regulator, the blast pressure regulator controls the pressure of the pressurized gas upstream of the mixer; and the pump air supply pressure regulator, wherein the pump air supply pressure regulator controls the air pressure to an air driven pump.

11. The wet abrasive blasting system of claim 10, wherein the first set of regulators comprise a first blast pressure regulator pressure setting and a first pump air supply pressure regulator pressure setting; the second set of regulators comprise a second blast pressure regulator pressure setting and a second pump air supply pressure regulator pressure setting; and the first blast pressure regulator pressure setting is different than the second blast pressure regulator pressure setting.

12. The wet abrasive blasting system of claim 11, wherein the first pump air supply pressure regulator pressure setting is different than the second pump air supply pressure regulator pressure setting.

13. The wet abrasive blasting system of claim 10, wherein the first blast pressure regulator setting is 2.5 to 3.5 times greater than the first pump air supply pressure setting.

14. The wet abrasive blasting system of claim 11, wherein the multiport selector valve comprises a third outlet port and a third set of regulators in fluid communication with the third outlet port and the third set of regulators comprises a third blast pressure regulator and a third pump air supply pressure regulator.

15. The wet abrasive blasting system of claim 14, wherein the multiport selector valve comprises a fourth outlet port and a fourth set of regulators in fluid communication with the fourth outlet port and the fourth set of regulators comprises a fourth blast pressure regulator and a fourth pump air supply pressure regulator.

16. A method of wet abrasive blasting, comprising:

setting an air supply pressure regulator to provide pressurized air to control a first pressure in the wet abrasive blasting system, wherein the first pressure is one of a pump discharge pressure and a blast pressure, wherein a second pressure of the wet abrasive blasting system is automatically set by means for automatically setting of the second pressure based upon the first pressure, wherein the second pressure is the other of the pump discharge pressure and the blast pressure.

* * * * *